US010150045B2

(12) United States Patent
Dubreuil

(10) Patent No.: US 10,150,045 B2
(45) Date of Patent: Dec. 11, 2018

(54) WRITING INSTRUMENT AND A TOY BUILDING SET COMPRISING SUCH A WRITING INSTRUMENT

(71) Applicant: LEGO A/S, Billund (DK)

(72) Inventor: Arnaud Dubreuil, Vejle (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 15/539,571

(22) PCT Filed: Jan. 13, 2016

(86) PCT No.: PCT/EP2016/050548
§ 371 (c)(1),
(2) Date: Jun. 23, 2017

(87) PCT Pub. No.: WO2016/113294
PCT Pub. Date: Jul. 21, 2016

(65) Prior Publication Data

US 2017/0368466 A1 Dec. 28, 2017

(30) Foreign Application Priority Data

Jan. 13, 2015 (DK) ..... 2015 70014

(51) Int. Cl.
*B43K 29/00* (2006.01)
*A63H 33/06* (2006.01)
(Continued)

(52) U.S. Cl.
CPC ..... *A63H 33/062* (2013.01); *A63H 33/06* (2013.01); *A63H 33/086* (2013.01); *B43K 7/005* (2013.01);
(Continued)

(58) Field of Classification Search
CPC ..... B43K 5/005; B43K 7/005; B43K 8/003; B43K 21/006; B43K 23/06; B43K 27/08; B43K 29/00; A63H 33/04; A63H 33/086
(Continued)

(56) References Cited

U.S. PATENT DOCUMENTS 4,561,184 A * 12/1985 Fujitani ..... A63H 3/003 33/27.02
4,702,633 A * 10/1987 Schmidt ..... B43K 7/005 401/194
(Continued)

FOREIGN PATENT DOCUMENTS

CN 2375463 Y 4/2000
EP 2620292 A1 7/2013
(Continued)

OTHER PUBLICATIONS

International Search Report issued in corresponding international application No. PCT/EP2016/050548, dated Apr. 14, 2016.
(Continued)

*Primary Examiner* — Alexander Niconovich
(74) *Attorney, Agent, or Firm* — Day Pitney LLP

(57) ABSTRACT

A writing instrument, comprising a tubular body having a longitudinal axis with a first and a second end, and with an opening arranged in the first end; a first building block having a body part with a substantially plane surface and one or more coupling knobs extending from the substantially plane surface, and where the first building block is fixed onto the outside of the tubular body so that the coupling knobs extend away from said longitudinal axis.

9 Claims, 2 Drawing Sheets

(51) Int. Cl.

| | |
|---|---|
| ***B43K 23/06*** | (2006.01) |
| ***B43K 7/00*** | (2006.01) |
| ***A63H 33/08*** | (2006.01) |
| *B43K 23/008* | (2006.01) |

(52) U.S. Cl.
CPC ..... *B43K 23/06* (2013.01); *B43K 29/00* (2013.01); *B43K 29/004* (2013.01); *B43K 23/008* (2013.01)

(58) Field of Classification Search
USPC ..... 401/34, 35, 88, 195; 446/112, 115, 146
See application file for complete search history.

(56) References Cited

U.S. PATENT DOCUMENTS

| | | | | | |
|---|---|---|---|---|---|
| 4,804,350 | A * | 2/1989 | Chen | A63H 33/04 | 446/112 |
| 5,044,804 | A * | 9/1991 | Chuang | B43K 5/005 | 401/34 |
| 6,086,445 | A * | 7/2000 | Zawitz | B43K 5/005 | 242/588.1 |
| 6,149,300 | A | 11/2000 | Greenway et al. | | |
| 6,149,330 | A * | 11/2000 | Chuang | B43K 7/005 | 401/34 |
| 6,425,703 | B1 * | 7/2002 | McDonnell | B43K 23/06 | 401/34 |
| 6,746,167 | B2 * | 6/2004 | Ahmed | B43K 8/003 | 401/35 |
| 7,607,848 | B1 * | 10/2009 | Ahmed | B43K 1/12 | 401/34 |
| 7,661,896 | B2 * | 2/2010 | Zawitz | B43K 5/005 | 401/6 |
| D611,985 | S * | 3/2010 | Puglisi | B43K 29/00 | D19/136 |
| 7,780,499 | B1 * | 8/2010 | Truckai | A63H 33/088 | 401/195 |
| 9,676,225 | B2 * | 6/2017 | Quiroz-Ziebart | B43K 19/003 | |
| 9,789,727 | B1 * | 10/2017 | Phillips | B43K 23/008 | |
| 2007/0041780 | A1 * | 2/2007 | Hsu | B43K 5/005 | 401/195 |
| 2011/0236119 | A1 * | 9/2011 | Richer | A63H 33/086 | 401/35 |
| 2018/0056208 | A1 * | 3/2018 | Nakashima | A63H 33/08 | |

FOREIGN PATENT DOCUMENTS

| | | | |
|---|---|---|---|
| FR | 2553716 | A3 | 4/1985 |
| JP | S62-107990 | U | 7/1987 |
| JP | H09-173656 | A | 7/1997 |
| JP | 2010 247464 | A | 11/2010 |
| WO | 1999/039797 | A1 | 8/1999 |
| WO | 2003/008203 | A1 | 1/2003 |
| WO | 2010/133650 | A2 | 11/2010 |
| WO | 2012/023948 | A1 | 2/2012 |
| WO | 2013/168614 | A1 | 11/2013 |

OTHER PUBLICATIONS

Written Opinion issued in corresponding international application No. PCT/EP2016/050548, dated Apr. 14, 2016.

* cited by examiner

WRITING INSTRUMENT AND A TOY BUILDING SET COMPRISING SUCH A WRITING INSTRUMENT

CROSS-REFERENCE TO RELATED APPLICATIONS

This application is a U.S. National Stage of International Application No. PCT/EP2016/050548, filed on 13 Jan. 2016 and published on 21 Jul. 2016, as WO 2016/113294 A1, which claims the benefit of priority to Danish Patent Application No. PA 2015 70014, filed on 13 Jan. 2015. The content of each of the above referenced patent applications is incorporated herein by reference in its entirety for any purpose whatsoever.

FIELD OF USE OF THE INVENTION

The present invention relates to a writing instruments and especially writing instruments for use in connection with toy building sets and comprising a tubular body with a first and a second end, and with an opening arranged in the first end, and having a longitudinal axis extending through the opening in the first end and to the second end, and at least one marking or erasing member extending in the tubular body along said longitudinal axis, and out through the opening in the first end.

In this relation the term writing instrument covers both such instruments for marking and for erasing existing markings on a surface.

STATE OF THE ART

Different embodiments of writing instruments suitable for interconnection with building elements in toy building sets are well known in the prior art.

Examples of such writing instruments are disclosed in e.g. WO patent application no. 2010/133650 and EP patent application no. 2620292.

OBJECT OF THE INVENTION

Based on this, it is the object of the present invention to propose a writing instrument as mentioned in the introduction to this description and providing on the one hand the same building quality as what is provided by interconnecting two building blocks in the toy building set, and on the other hand the option of producing major parts of the writing instrument with less requirements with regard to the production quality According to the invention this is obtained by having a first building block having a body part with a substantially plane surface and one or more coupling knobs extending from the substantially plane surface, and by having a recess arranged on the outside of the tubular body, the recess allowing the first building block to be mounted in a countersunk position on one side of the tubular body so that the coupling knobs extend away from said longitudinal axis.

In a preferred embodiment the writing instrument comprises a second building block having a body part with one or more complementary coupling parts configured for releasable interconnection with another element having a substantially plane surface and one or more coupling knobs corresponding to the one or more coupling knobs on the first building block, and the second building block is attached onto the outside of the tubular body so that the complementary coupling parts extend away from said longitudinal axis.

The first and the second building block may preferably be arranged on opposite sides of the tubular body.

In this relation the first and the second building block are advantageously attached to the tubular body at overlapping positions along the longitudinal axis, and preferably near the second end of the tubular body.

Furthermore the second end of the tubular body is preferably closed, and is provided with a first recess, configured for mounting the first building block in a countersunk position on the tubular body, arranged at the closed second end.

Preferably the first recess is arranged in a first substantially plane surface on the tubular body, and having a depth so that the first building block is countersunk into the first substantially plane surface so that the substantially plane surface on the building block flushes with the first substantially plane surface on the tubular body.

Correspondingly the second recess, configured for mounting the second building block in a countersunk position on the tubular body, is arranged at the closed second end, and the second recess is arranged in a second substantially plane surface on the tubular body, and in that the depth, by which the second building block is countersunk into the second substantially plane surface, is so that the complementary coupling parts on the second building block extends a distance away from the second substantially plane surface on the tubular body corresponding to or longer than the height of the couplings knobs on the first building block.

LIST OF FIGURES

EMBODIMENT OF THE INVENTION

Figure 1:
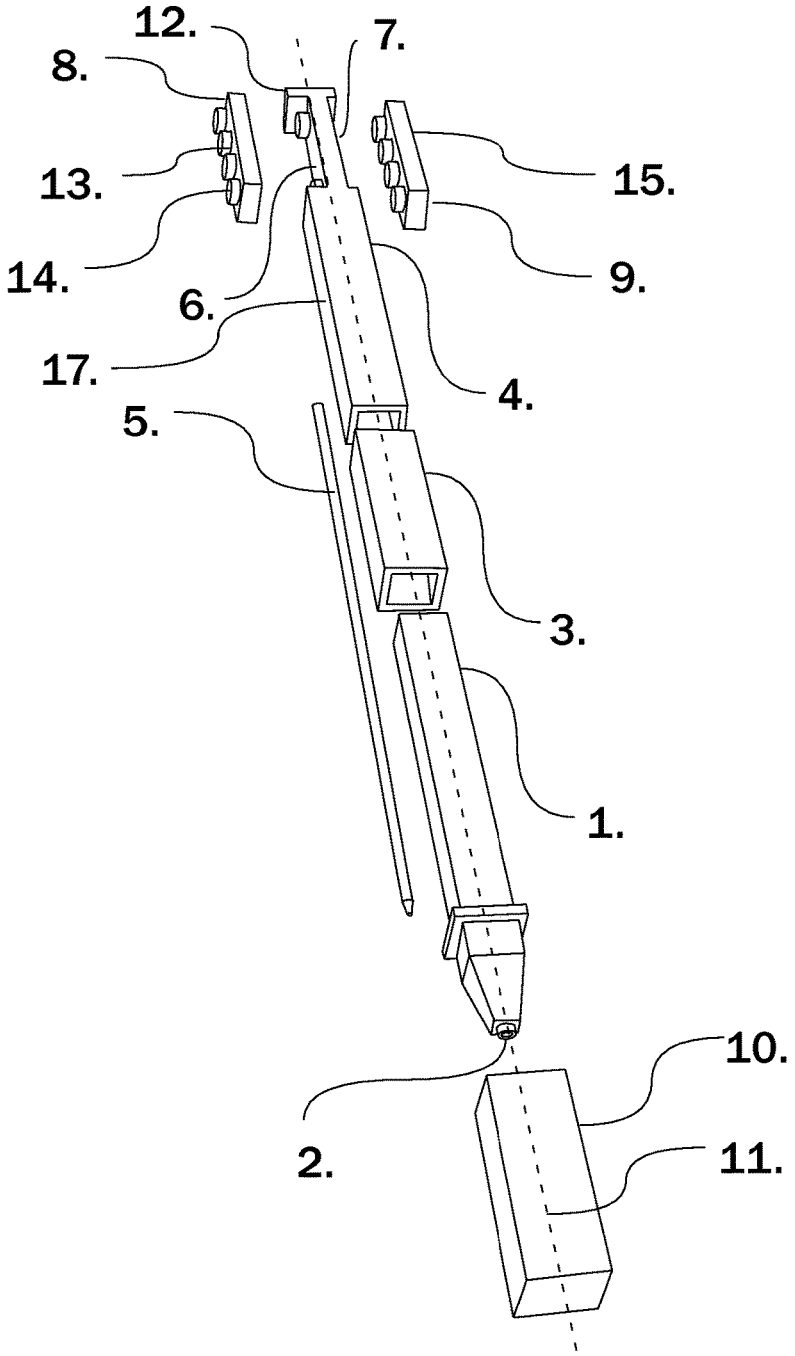
FIG. 1 is an exploded perspective drawing of a writing instrument according to the invention.
Figure 2:
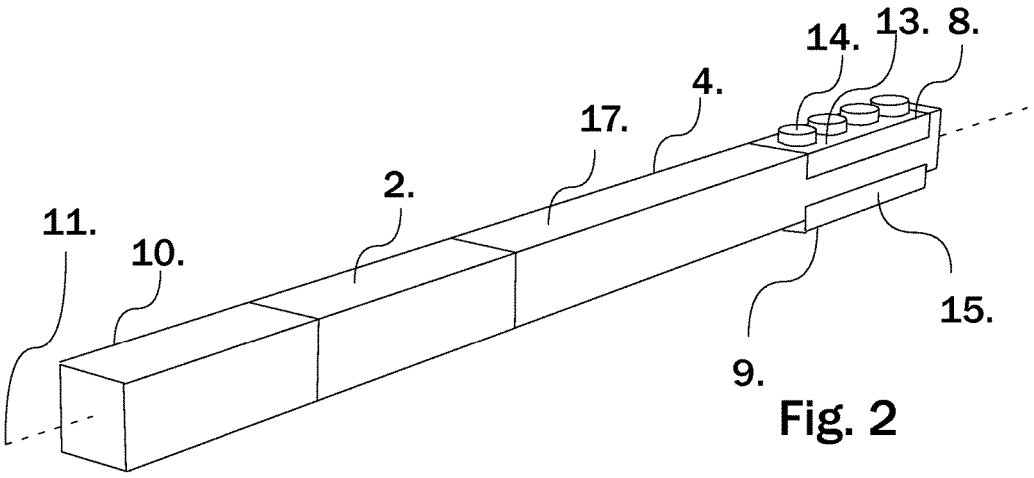
FIG. 2 shows the writing instrument from FIG. 1 in an assembled state.
Figure 3:
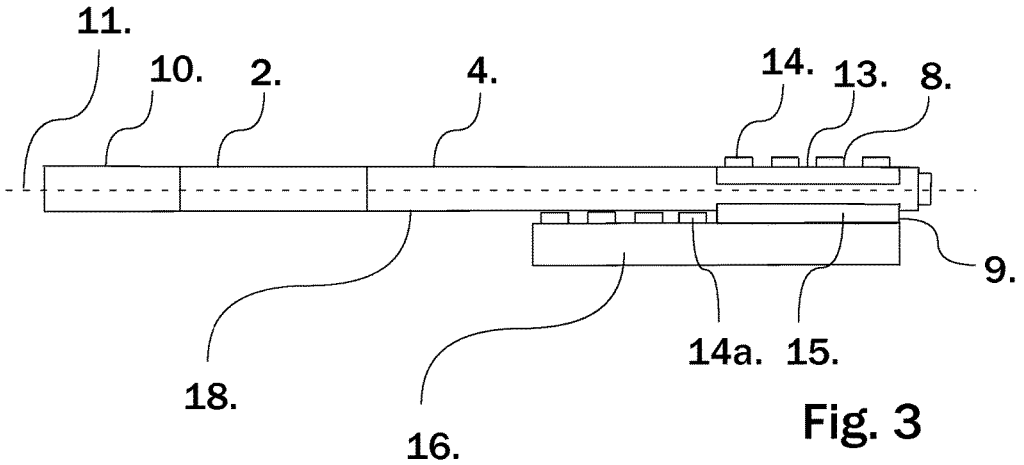
FIG. 3 is a side view of the writing instrument, attached to another building element in a toy building set.

Thus, FIG. 1 shows the components of one embodiment of a writing instrument according to the invention, and FIGS. 2 and 3 shows the assembled state of the same writing instrument.

In this embodiment the writing instrument is a ballpoint pen having a tubular body formed by a pointed front end 1 having an opening 2 arranged in the pointed end, a silicone grip 3 for increasing friction for better handling of the ballpoint pen, and a rear end 4 that is slides over the pointed end to form a closed end 12 on the tubular body. Before assembling the tubular body the ballpoint pen cartridge 5 can be inserted in the pointed front end so that only the tip of the ballpoint pen cartridge 5 extends out of the opening 2.

Thereby the pointed front end 1 and the rear end 4 forms the tubular body extending along the longitudinal axis 11

At the rear end 4 two recesses 6, 7 are arranged allowing the first and the second building blocks 8, 9 to be mounted in a countersunk position on the rear end 4 of the tubular body.

In this embodiment the ballpoint pen also comprise a cap 10 not forming part of the tubular body but it is evident that such a cap 10 may be superfluous especially in embodiments where the writing instrument is an eraser or a mechanical pencil with exchangeable lead mines.

According to the invention the first building blocks has a substantially plane surface with four coupling knobs 14 extending from it.

Furthermore the second building block 9 has complementary coupling parts here formed by a set of coupling skirts 15 formed so that they can engage frictionally with a set of coupling knobs 14 corresponding to those on the first building blocks 8.

Thereby the writing instrument according to the invention is suitable for mounting on other element in a toy construction set such as shown in FIG. 3, where the writing instrument is mounted on the building block 16 so that the coupling knobs 14*a* on the building block 16 extends into the second building block 9 from below and thereby frictionally engages with the couplings skirts 15 on the second building block 9.

In this relation, and in order to ensure that the first and the second building blocks 8, 9 stays on the tubular body 1, 4 when it is used as a component in a construction building set, then the first and/or the second building blocks 8, 9 are preferably glued or welded in place in their position in the recesses 6, 7, or alternatively they are mounted with a press fit or a snap fit.

In this embodiment the substantially plane surface 13. On the first building block 8 flushes with the first substantially plane surface 17 on the tubular body 1, 4, and the couplings skirts 15 extends a distance below the second substantially plane surface 18 on the tubular body 1, 4 corresponding to or longer than the height of the couplings knobs 14 on the first building block 8. Thereby the writing instrument may easily be built into many different constructions disregarding the size and position of the building blocks mounted onto the first and/or the second building block 8, 9.

Although some embodiments have been described and shown in detail, the invention is not restricted to them, but may also be embodied in other ways within the scope of the subject matter defined in the following claims. In particular, it is to be understood that other embodiments may be utilized and structural and functional modifications may be made without departing from the scope of the present invention. As an example of this it will be apparent to the skilled person that the invention may also be used in relation to hearing aids having other or different functional components arranged in the hearing aid housing 1 or the sound emitter 2 than what has been mentioned above.

In device claims enumerating several features, several of these features can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A writing instrument, comprising:

a tubular body comprising:

a first and a second end, and with an opening arranged in the first end, and having a longitudinal axis extending through the opening in the first end and to the second end; and at least one marking or erasing member extending in the tubular body along said longitudinal axis, and out through the opening in the first end; and a first building block having a body part with a substantially plane surface and one or more coupling knobs extending from the substantially plane surface;

wherein a recess is arranged in a first substantially plane surface on the tubular body, the recess allowing the first building block to be mounted in a countersunk position into the recess of the first substantially plane surface of the tubular body so that the coupling knobs extend away from said longitudinal axis; and wherein a depth of the recess into which the first building block is countersunk equals the height of the first building block such that the substantially plane surface of the first building block flushes with the first substantially plane surface on the tubular body.

2. The writing instrument according to claim 1, further comprising a second building block having a body part with one or more complementary coupling parts configured for releasable interconnection with another element having a substantially plane surface and one or more coupling knobs corresponding to the one or more coupling knobs on the first building block, and where the second building block is attached onto the outside of the tubular body so that the complementary coupling parts extend away from said longitudinal axis.

3. The writing instrument according to claim 2, wherein the first and the second building block are arranged on opposite sides of the tubular body.

4. The writing instrument according to claim 3, wherein the first and the second building block are attached to the tubular body at overlapping positions along the longitudinal axis.

5. The writing instrument according to claim 4, wherein the first and the second building element are both positioned near the second end of the tubular body.

6. The writing instrument according to claim 2, wherein the second end of the tubular body is closed, and where a first recess, configured for mounting the first building block in a countersunk position on the tubular body, is arranged at the closed second end.

7. The writing instrument according to claim 6, wherein a second recess, configured for mounting the second building block in a countersunk position on the tubular body, is arranged at the closed second end.

8. The writing instrument according to claim 7, wherein the second recess is arranged in a second substantially plane surface on the tubular body, and wherein a depth, by which the second building block is countersunk into the second substantially plane surface, is so that the complementary coupling parts on the second building block extends a distance away from the second substantially plane surface on the tubular body corresponding to or longer than a height of the couplings knobs on the first building block.

9. A toy building set comprising a writing instrument according to claim 2, and further comprising another element having one or more coupling parts configured for interconnection with said coupling knobs on the first building block or the complementary coupling parts on the second building block.

* * * * *